United States Patent [19]

Haag et al.

[11] 4,131,871

[45] Dec. 26, 1978

[54] ELECTRICAL DEVICE AND METHOD

[75] Inventors: Donald L. Haag, Sterling; Lee O. Woods, Morrison, both of Ill.

[73] Assignee: General Electric Company, Fort Wayne, Ind.

[21] Appl. No.: 761,584

[22] Filed: Jan. 24, 1977

[51] Int. Cl.[2] ..... H01C 13/00

[52] U.S. Cl. ..... 338/220; 29/621

[58] Field of Search ..... 338/220, 23–25; 29/621

[56] References Cited

U.S. PATENT DOCUMENTS

| | | | |
|---|---|---|---|
| 3,921,117 | 11/1975 | Blaha | 338/220 |
| 3,925,748 | 12/1975 | Slocum | 338/220 X |

*Primary Examiner*—C. L. Albritton

*Attorney, Agent, or Firm*—Joseph E. Papin

[57] ABSTRACT

An electrical device has a casing, a solid state component, and a pair of means in the casing for electrical contacting and positioning engagement with the solid state component. A pair of terminal means are disposed in the casing for connection in circuit with the engagement means, respectively, and at least one of the terminal means is adapted for limited displacement movement in the casing upon the mounting association of the terminal means with a pair of mating terminals. The at least one terminal means includes means associated both mechanically and electrically with one of the engagement means and adapted for isolating the one engagement means from the limited displacement movement of the at least one terminal means upon the mounting association of the terminal means with the mating terminals.

A method of making an electrical device is also disclosed.

27 Claims, 13 Drawing Figures

ELECTRICAL DEVICE AND METHOD

FIELD OF THE INVENTION

This invention relates in general to electrical devices and in particular to those utilized in the starting or starting and protecting of dynamoelectric machines and also a method of making an electrical device.

BACKGROUND OF THE INVENTION

In the past, various protector devices have been employed for taking a winding circuit of a dynamoelectric machine off the line in the event of the occurrence of a winding circuit overload which, of course, may have a deleterious affect on components of such dynamoelectric machine, such as for instance burning out the winding circuit. One such protector device is disclosed in U.S. Pat. No. 2,771,528 issued to D. E. Moran on Nov. 20, 1956. Also in the past, various starter devices have been employed to render a start winding generally ineffective in the winding circuit of a dynamoelectric machine, such as a split phase electric motor for instance, when the dynamoelectric machine is energized and attains a preselected speed. Some of these starter devices are well known to the art, such as centrifugal starting switches and starting relays or the like. Positive temperature coefficient resistors have also been employed as starter devices with the winding circuit of a split phase motor to render the start winding generally ineffective at a preselected motor speed, as shown for instance in the electrical devices illustrated in U.S. Pat. No. 3,737,752 and U.S. Pat. No. 3,559,016, respectively.

These past motor starter devices and protector devices were mounted to a dynamoelectric machine in various manners. For instance, some were disposed on a terminal board in the dynamoelectric machine, and others were laced or otherwise disposed in or adjacent the windings of the dynamoelectric machine. Still others of the past starter devices and protector devices were mounted to the housing of a dynamoelectric machine and connected by leads to the winding circuit thereof.

In an air conditioning or refrigeration compressor unit or the like, a hermetic motor is sealed therein, and either a male or female plug member or cluster is connected in circuit relation with the winding circuit of the hermetic motor and remotely located therefrom so as to be mounted on a housing or jacket of the compressor unit. U.S. Pat. Nos. 3,921,117 and 3,955,170 respectively disclose plug-on and plug-in type motor starter devices which may be assembled to the aforementioned male or female plug members of a compressor unit. In U.S. Pat. No. 3,168,661 a combination starter-protector device is disclosed as being plugged onto a male plug member, such as that previously mentioned. Other combination starter-protector devices are illustrated in U.S. Pat. Application Ser. No. 624,381 filed Oct. 25, 1975 and U.S. Pat. Application Ser. No. 693,409 filed June 7, 1976, both of which are assigned to the common assignee of this application.

Variations in the tolerances of the male terminal with respect to the size thereof and/or in the mounted spacing thereof in the aforementioned plug members are, of course, encountered, and such tolerance variations may also prevail in the cooperating female terminals of the electrical device adapted to be assembled onto such plug members. Due to such variations, at least one of the disadvantageous or undesirable features of such past electrical devices is believed to be that the female terminals thereof were sometimes rather loosely mounted on the cooperating male terminals of the plug members. Of course, it is also believed that such loose mounting resulted in an ancillary disadvantageous or undesirable feature wherein the female terminals of the past electrical devices may have been displaced from their cooperating male terminals of the plug members in response to vibrations or the like established by or during the operation of the apparatus with which the plug members are associated. Still another ancillary disadvantageous or undesirable feature effected by the aforementioned loose mounting is believed to be that such looseness may result in increased electrical resistance between the male terminal and the female terminal so as to cause overheating.

When the aforementioned tolerance variations do exist, another disadvantageous or undesirable feature of the past electrical devices is believed to be be that the female terminals thereof may be spread apart and/or twisted when such female terminals are inserted into assembly engagement with the male terminals of the plug member. A further disadvantageous or undesirable feature of the past electrical devices is believed to be that the spreading and/or twisting movement of the female terminals in response to the assembly thereof on the male terminals may have been transmitted to other electrical components of the electrical device connected with the female terminals thereof so as to deleteriously affect such other electrical components and/or their connections with the female terminals. For instance, in some of the past devices, a PTCR was embraced between contact plates of the female terminals, and the aforementioned displacement movement of the female terminals upon mounting association with the male terminals is believed to have caused the contact plates to abrase or scrub the chemically treated surfaces of the PTCR with which the contact plates were engaged. In this manner, the abrasions caused by the rubbing engagement of the contact plates against the chemically treated surfaces of the PTCR is believed to have caused hot spots therein resulting in the failure of the PTCR.

SUMMARY OF THE INVENTION

Among the several objects of the invention may be noted the provision of an improved electrical device and a method of making an electrical device which overcome the disadvantageous or undesirable features discussed hereinabove, as well as others, with respect to the prior art; the provision of such improved electrical device and method in which limited displacement movement of at least one terminal means in the electrical device effected upon the assembly thereof with mating mounting terminals is generally isolated from at least another component of the electrical device connected with the terminal means; and the provision of such improved electrical device and method having components which are simplistic in design, and easily manufactured and/or assembled. These as well as other objects and advantageous features of the invention will be in part apparent and in part pointed out hereinafter.

In general, an electrical device in one form of the invention is adapted to be associated in electrical contacting engagement with a set of terminals for connection in circuit relation with a winding circuit of a dynamoelectric machine. The electrical device has a casing, means for controlling starting of the dynamoelectric machine, and a pair of means for electrically contacting and supporting the starting means in the casing. A set of means is disposed in the casing so as to be limitedly displacably movable for receiving respective ones of the terminals of the terminal set upon the association in the electrical contacting engagement therewith and also connected in electrical conductive engagement with the contact and supporting means. The receiving means of the set thereof include means for at least limiting translation of the displacement movement from the receiving means to the contact and supporting means in the event of the occurrence of the displacement movement upon the association of the receiving means with the respective ones of the terminals.

Also in general and in one form of the invention, the above described electrical device may utilize a controlling means operable generally in response to current applied thereto to increase its resistance generally as a function of the temperature so as to render a start winding of the winding circuit generally ineffective therein when the dynamoelectric machine is engaged to a preselected speed. Another circuit for controlling the passage of the current to the winding circuit includes a thermally responsive current carrying switch means in the casing and operable from a current passing position toward a current interrupting position in response to a preselected thermal condition occasioned upon winding circuit overload. Means is provided for connecting the switch means in circuit relation with one of the contact and supporting means, and the controlling means and switch means are associated in heat transfer relation so as to delay the return of the switch means from its current interrupting position in response to heat of the controlling means upon the application of current thereto.

Also in general, a method in one form of the invention is provided for making an electrical device so as to generally isolate an electrical component thereof from limited displacement movement of terminal means supported in the electrical device and associated both mechanically and electrically with the electrical component upon the mounting of the terminal means to a mating terminal. This method comprises integrally forming one of a pair of legs of a generally U-shaped configuration with a socket portion of the terminal means and connecting the other of the legs in the mechanical and electrical association with the electrical component so that at least one of the one and other legs generally absorbs the limited displacement movement of the terminal means upon the mounting thereof to the mating terminal.

BRIEF DESCRIPTION OF THE DRAWINGS

Corresponding reference characters indicate corresponding parts throughout the several views of the drawings.

The exemplifications set out herein illustrate preferred embodiments of the invention in one form thereof, and such exemplifications are not to be construed as limiting the scope of the invention in any manner.

DETAILED DESCRIPTION OF THE PREFERRED EMBODIMENTS

Figure 1:
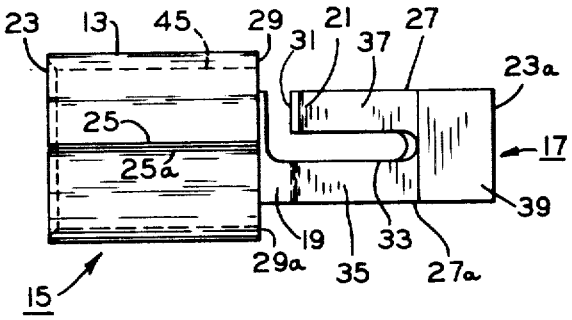
FIG. 1 is a greatly enlarged plan view of a terminal.
Figure 2:
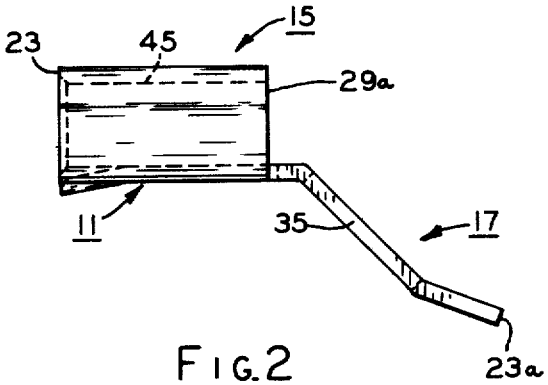
FIG. 2 is a side elevational view of the terminal of FIG. 1.
Figure 3:
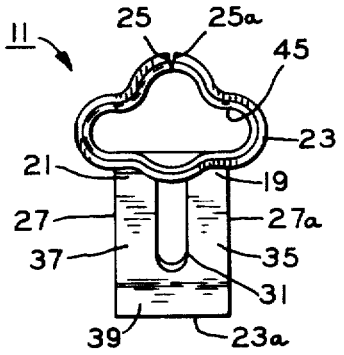
FIG. 3 is a left end elevational view of the terminal of FIG. 1.

Referring now to the drawings in detail and in particular to FIGS. 1–3, a terminal or terminal means 11 has an integral body 13 formed of a generally thin material, such as a strip of metal for instance, which has good electrical conductive properties or characteristics. Body 13 has means, such as an electrical connector section illustrated as a female socket or split sleeve portion 15 for instance, for receiving in releasable electrical contacting engagement another terminal adapted for association therewith, as discussed in greater detail hereinafter. Means, such as a supporting or connection section illustrated as a generally U-shaped configuration or a tab 17 for instance, is integral with split sleeve portion or receiving means 15 and adapted for association or connection in electrical conductive relation, such as both electrical and mechanical engagement for instance, with an electrical component, as also discussed in greater detail hereinafter. Connection means or the U-shaped configuration 17 comprises a pair of spaced apart generally opposite adjacent end portions 19, 21 with one of the end portions 19 being integral with split sleeve portion 15 while the other of the end portion 21 is spaced generally adjacent the split sleeve portion for the connection or association with the aforementioned electrical component. U-shaped configuration 17 also includes means, such as at least one resilient or yieldable section, between end portions 19, 21 thereof operable generally for yielding in the event of the occurrence of displacement movement of split sleeve portion 15 upon the association thereof in the electrical contacting engagement with the aforementioned another terminal so as to at least in part limit the translation or transmission of such displacement movement from the split sleeve portion through the U-shaped configuration to the aforementioned electrical component when it is associated with end portion 21. While supporting section 17 is illustrated and described as a generally U-shaped configuration merely for convenience of disclosure, it is contemplated that configurations other than such generally U-shaped configurations may be utilized within the scope of the invention so as to achieve the objects and advantages thereof. Furthermore, it is also contemplated that electrical connector sections other than the female socket or split sleeve portion 15 illustrated merely for purposes of disclosure may be employed with terminal 11 within the scope of the invention in order to meet the objects and advantages thereof.

Figure 4:
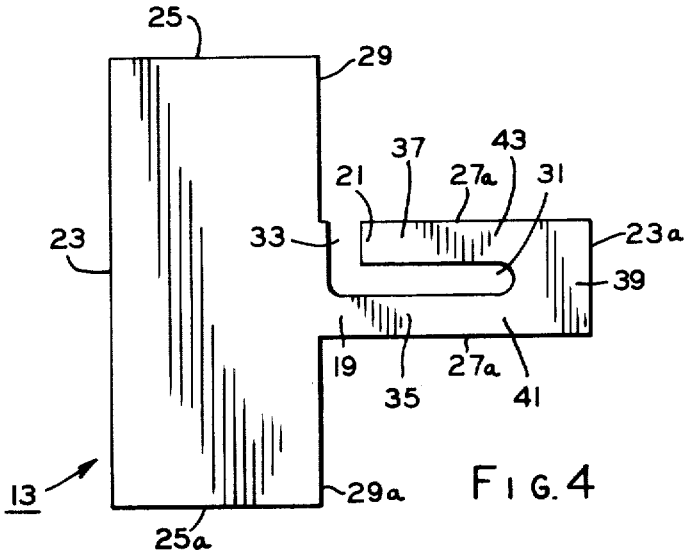
FIG. 4 is a plan view of a blanked-out body of the terminal of FIG. 1.

More particularly and referring also to FIG. 4, body 13 of female terminal 11 may be blanked punched or otherwise formed from a thin metallic material or sheet, and in its blanked-out form, the body has a pair of opposite ends or end edges 23, 23a. A first pair of opposite side edges 25, 25a are provided on body 13 intersecting with end edge 23, and a second pair of opposite side edges 27, 27a are also provided on the body intersecting with end edge 23a. A pair of shoulders, such as generally perpendicular edges 29, 29a are provided on body 13 so as to interconnect or intersect with side edges 25, 25a and 27, 27a, respectively. Slot means, which comprise a pair of intersecting or integrally formed slots or slot portions 31, 33 are disposed through supporting section 17 of body 13. Slot portion 31 extends generally from at least adjacent shoulders 29, 29a toward end edge 23a being disposed between side edges 27, 27a, and slot portion 33 is disposed generally adjacent shoulder 29 extending from slot portion 31 so as to intersect with side edge 27. In this manner, it may be seen that the interposition of slot portion 31 between side edges 27, 27a defines a pair of spaced apart legs or generally elongate sections 35, 37 disposed generally in laterally spaced relation on supporting section 17, and the intersection of slot portion 33 with side edge 27 defines free end or end portion 21 on leg 37 so as to be spaced generally adjacent shoulder 29, i.e. split sleeve portion 15.

A distal end or bight portion 39 is integrally provided on supporting section 17 between generally end edge 23a of body 13 and the rightward end of slot portion 31 so as to be predeterminately spaced from split sleeve portion 15 (as best seen in FIG. 4). Leg 35 includes end portion 19 which, as previously mentioned is integral with split sleeve portion 15, and end portion 19 is generally opposite with respect to another end or end portion 41 of the leg which is integrally formed with distal end 39 of supporting section 17. Leg 37 is also provided with another end or end portion 43 which is disposed generally in opposite relation with respect to free end 21 of the leg, and end portion 43 is also integrally formed with distal end 39 of supporting section 17. The aforementioned yielding means or section of supporting section 17 is located in at least one of legs 35, 37 between opposite end pairs 19, 41 and 21, 43, respectively, as discussed in detail hereinafter.

Subsequent to the above described blanking of terminal 11, split sleeve portion 15 may be formed by rolling, bending or other such shaping methods generally into the configuration illustrated in FIG. 3. In this manner, side edges 25, 25a of body 13 are displaced and positioned generally in opposed or facing relation with each other so as to provide an opening 45 that extends through split sleeve portion 15 generally between end edge 23 and shoulder pair 29, 29a thereof. Of course, opposed side edges 25, 25a defines the split extending the length of split sleeve portion 15 and intersects with opening 45 thereof so that the split sleeve portion may resile or be displacably movable, i.e. to expand or spring open, in order to accommodate a male terminal which may be inserted into the opening into electrical contacting and/or mounting engagement with terminal 11, as discussed hereinafter. While electrical connector section 15 and opening 45 thereof are provided with the particular shapes or configurations illustrated in FIGS. 1-3 merely for convenience of disclosure, it is contemplated that other electrical connector sections may be employed having various other configurations and that other openings may be utilized assuming a variety of other shapes within the scope of the invention so as to attain the objects and advantages thereof. Leg pair 35, 37 may also be stamped, bent or otherwise deformed so as to extend from split sleeve portion 15 in the shape illustrated generally in FIG. 2; however, while legs 35, 37 are provided with such particularly illustrated shapes and are described hereinabove as being disposed generally in laterally spaced relation with respect to each other, it is contemplated that legs having shapes other than those illustrated and being arranged in other spaced relations may also be utilized within the scope of the invention so as to meet the objects and advantages thereof. For instance, at least a part of one of legs 35, 37 may be skewed or bent with respect to at least a part of the other of the legs so as to extend generally in different planes. Furthermore, legs 35, 37 may be shaped before, after or generally simultaneously with the shaping of split sleeve portion 15, as described above. Of course, it is also contemplated that one of legs 35, 37, or at least a part thereof, may be provided with a crosssection or width, i.e. between slot 31 and side edges 27, 27a of body 13, which is less than that of the other of the legs so as to predetermine the location of the aforementioned yieldable means or portion of the legs adapted to resile or yield in order to effectively absorb or accommodate limited displacement movement of the split sleeve portion upon the association thereof with a male mounting terminal, as discussed hereinafter.

Figure 5:
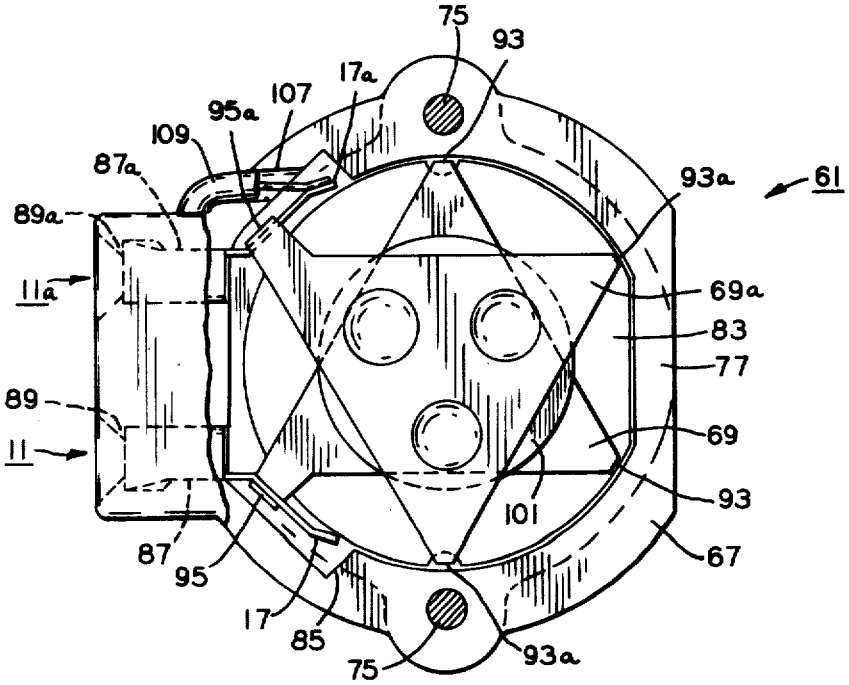
FIGS. 5 and 10 are plan views of electrical devices in one form of the invention with a portion of the casing thereof broken away and illustrating principles of a method of making an electrical device in one form of the invention, respectively.
Figure 7:
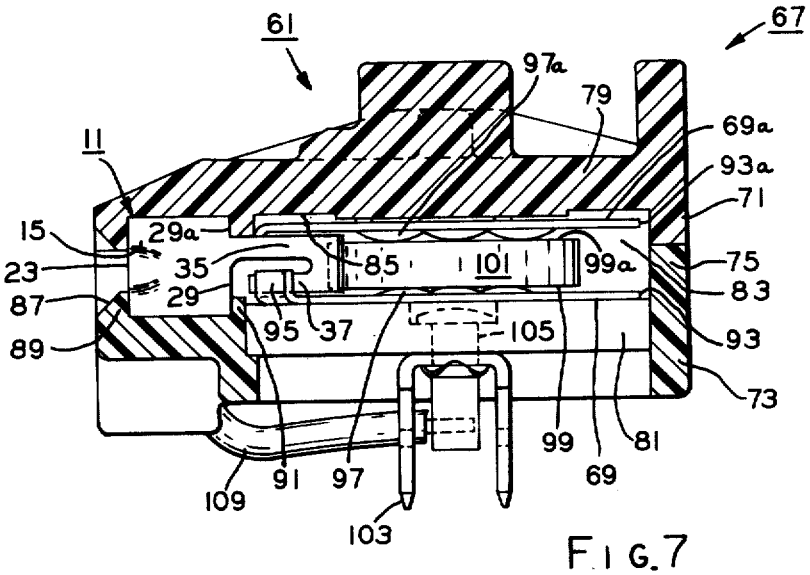
FIGS. 7 and 12 are sectional views taken along line 7—7 and 11—11 of FIGS. 5 and 10, respectively.
Figure 9:
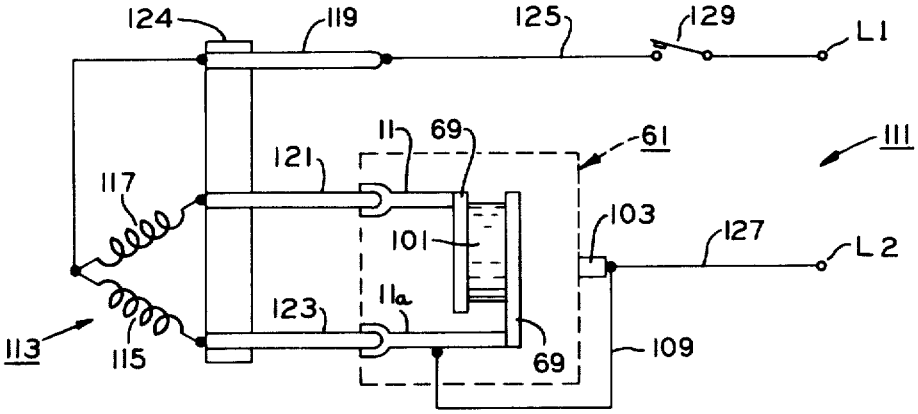
FIGS. 9 and 13 are schematic circuit diagrams illustrating the use of the electrical devices of FIGS. 5 and 10 in circuit relation with a winding circuit of a prime mover, respectively.

Referring now to the drawings in general and recapitulating, at least in part, with respect to the foregoing, an electrical device 61 in one form of the invention is adapted to be associated in electrical contacting engagement with at least one terminal means, such as a male mounting terminal of a set thereof, for a winding circuit of a dynamoelectric machine, as described in detail hereinafter (FIG. 9). Electrical device 61 has a casing 67, and an electrical component or contacting and supporting means, such as a contact plate 69, is supported or disposed generally in a preselected position in the casing (FIGS. 5 and 7). Means, such as split sleeve portion 15 of terminal 11, for receiving the at least one terminal means or male mounting terminal 63a in the electrical contacting engagement therewith is disposed in casing 67 so as to be limitedly displacably movable upon the association with the male mounting terminal (FIGS. 1-3, 5 and 7). Means, such as supporting section 17 of terminal 11, extends from split sleeve portion or receiving means 15 for connection in electrical conductive relation or association, i.e. in both electrical contacting engagement and mechanical engagement, with contact plate 69 so as to dispose the contact plate in its preselected position in casing 67. Connection means or supporting section 17 includes means, such as at least one of legs 35, 37, for accommodating the limited displacement movement of split sleeve portion 15 so as to at least generally isolate contact plate 69 from the limited displacement movement upon the association of the split sleeve portion with male mounting terminal 63a.

Figure 6:
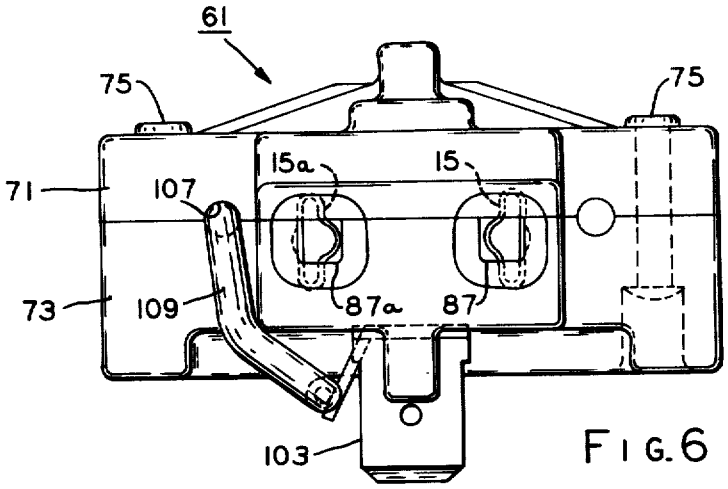
FIGS. 6 and 11 are left side elevational views of the electrical devices of FIGS. 5 and 10, respectively.

More particularly and with specific reference to FIGS. 5-7, it may be noted that only terminal 11 and plate 69 are described herein in detail, but the letter "a" will be employed hereafter to designate corresponding component parts of another terminal 11a and another contact plate 69a which, for purposes of disclosure, have generally the same constructions as terminal 11 and contact plate 69, respectively; however, it is contemplated that such terminals and contact plates may be of dissimilar constructions within the scope of the invention so as to meet the objects and advantageous features thereof.

Casing 67 is provided with a pair of separable casing members 71, 73 which are retained against displacement from each other by suitable fastening means, such as a plurality of rivets 75 or the like. Casing members 71, 73 comprise a plurality of wall means including a sidewall 77 integrally formed or interconnected between a pair of opposed spaced apart walls, such as an end or top wall 79 and an end or base wall 81, and such wall means plurality defines a chamber 83 within casing 67. At least one groove or recess means 85 is provided in sidewall 77 communicating with chamber 83, and supporting sections **17, 17*a* of terminals 11, 11*a* are disposed in or extend into the recess means. A pair of generally parallel, spaced apart openings or terminal containing apertures 87, 87*a* extend through sidewall 77 of casing 67 having interior ends intersecting with recess means 83 and exterior ends opening exteriorly of the casing, respectively, and electrical connector sections 15, 15*a* of terminals 11, 11*a* are respectively disposed for limited displacement movement within the openings, as discussed in detail hereinafter. A pair of means, such as shoulders or stops 89, 91 and 89*a*, 91*a* or the like, are integrally provided on casing 67 generally adjacent the interior and exterior ends of openings 87, 87*a* so as to abut with shoulders 29, 29*a* and opposite end 23 of electrical connector sections 15, 15*a* on terminals 11, 11*a*** for containing or trapping the electrical connector sections within the opening.

Figure 8:
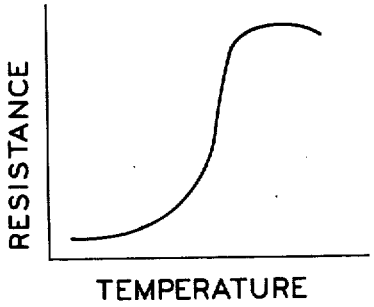
FIG. 8 is a graphical representation of typical resistance and temperature characteristics of a PTCR utilized in the electrical devices of FIGS. 5 and 10, respectively.

Contact plates **69, 69*a* are illustrated for pusposes of disclosure as having a generally flat triangular shape, but it is contemplated that contact plates having various other shapes or configurations may be employed within the scope of the invention so as to meet the objects and advantageous features thereof. Contact plates 69, 69*a* are located or supported on opposed end walls 79, 81 of casing 67 within chamber 83, and it is contemplated that resilient means (not shown) may be provided between at least one of the opposed end walls and the contact plate for urging it generally toward the other of the contact plates. A plurality of means, such as abutment or side edge portion indicated at 93, 93*a*, are provided on contact plates 69, 69*a* for respective positioning or locating engagement with sidewall 77 of casing 67, and extension means, such as bent fingers 95, 95*a*, are integrally provided on contact plates 69, 69*a* extending therefrom for the aforementioned connection in both the mechanical and electrical engagement with free end portions 21, 21*a* of legs 37, 37*a* on terminals 11, 11*a*, respectively, by suitable means, such as soldering for instance (not shown). A plurality of indentations or dimples 97, 97*a* may be provided in contact plates 69, 69*a* so as to insure good electrical contacting and mechanical supporting or positioning engagement with a pair of opposite sides 99, 99*a* of means, such as a generally cylindrically shaped PTCR 101, operable generally for controlling starting of a dynamoelectric machine when connected in circuit relation therewith, as discussed in detail hereinafter. PTCR 101 is operable generally in response to current flow therethrough to vary or increase its resistance generally as a function of its temperature, as illustrated in FIG. 8, so as to generate heat when energized, and of course, opposite sides 99, 99*a* of PTCR 101 are coated or otherwise covered or layered with a chemical composition (not shown) so as to insure the generally even or constant flow or distribution of current through the PTCR from one of the opposite sides to the other thereof. In this manner, PTCR 101, is embraced, i.e., supported or positioned in both the electrical contacting and positioning or supporting engagement, between contact plates 69, 69*a* within chamber 83 of casing 67. While PTCR 101** is shown having a generally cylindric shape, it is contemplated that a PTCR having a shape other than cylindric may be employed within the scope of the invention so as to meet the objects thereof.

A plug-on or quick disconnect type terminal or terminal means 103 is attached by suitable means, such as a rivet 105 for instance, to opposite end wall 81 of casing 67 so as to be disposed exteriorly thereof. To complete the description of electrical device 61, a lead receiving opening or aperture 107 is provided through sidewall 77 of casing 67 so as to intersect with recess means 85, and an electrical lead 109 extends through opening 107 having an interior end electrically connected with supporting section **17*a* of terminal 11*a* and an exterior end electrically connected with terminal means 103. Of course, lead 109 defines, at least in part, circuit means in which terminal means 11 and contact plate 69 are placed in series circuit relation across PTCR 101 with both contact plate 69*a* and terminal 11*a* and terminal means 103**.

As illustrated in an exemplary schematic diagram of a circuit 111 in FIG. 9, a prime mover, such as an electric motor 113, is provided with a winding circuit comprising a main or run winding 115 and an auxiliary or start winding 117 connected in circuit relation therein. An assembly or set of mounting or male terminals or terminal means 119, 121, 123 are fixedly mounted in a plug or the like 124 adapted for mounting assembly or association to a structural component (not shown) in which motor 113 may be housed; however, it is contemplated that terminal plug 124 may be remotely mounted with respect to the motor to another structural component, such as a jacket or housing of a device driven by the motor such as a compressor or the like for instance (not shown). Further, male terminals 119, 121, 123 may be predeterminately spaced apart and sized within tolerance limits so as to meet certain industry — wide standards or other specifications. Male terminals 121, 123 are respectively connected in circuit relation with start winding 117 and run winding 115 of motor 113, and male terminal 119 is connected in circuit relation with both the start and run windings. Female terminals **11, 11*a* of electrical device 61 are disposed to releasably receive male terminals 121, 123 of the terminal set in electrical conductive relation when the electrical device is associated or assembled with motor 113, and a pair of leads 125, 127 are respectively connected between line terminals L1, L2 and male terminal 119 and terminal means 103 of electrical device 61. To complete the description of circuit 111, a motor energizing switch 129 may be interposed in lead 125**.

As previously mentioned, variations in the tolerances of male terminals 119, 121, 123 with respect to the size thereof and/or the spaced relation therebetween in plug member 124 are, of course, encountered, and such tolerance variations may also occur in electrical connection sections **15, 15*a* of terminals 11, 11*a* in electrical device 61, as previously mentioned. Due to the aforementioned tolerance variations, electrical connector sections 15, 15*a* of terminals 11, 11*a* may twist and/or be both laterally and longitudinally moved or otherwise displaced within their respective openings 87, 87*a* of casing 67 when the electrical connector sections are releasably or grippingly engaged in electrical conductive relation on male terminals 121, 123 so as to mount electrical device 61 in circuit relation on mounting plug 124. Upon the assembly of electrical device 61 to mounting plug 124, as above described, the transmission or translation of the displacement movement of electrical connector sections 15, 15a through supporting sections 17, 17a of terminals 11, 11a to contact plates 69, 69a is at least predeterminately limited or accommodated by the yielding or resiling of at least one of legs 35, 37 and legs 35a, 37a of the supporting sections, respectively. In this manner, the above described means of supporting sections 17, 17a for accommodating the displacement movement of electrical connector sections 15, 15a at least predeterminately limits or obviates the transmission of such displacement movement to contact plates 69, 69a so as to maintain them generally in their assembled positions within chamber 83 of casing 67 which results in the preservation of the chemically coated opposite sides 99, 99a of PTCR 101 from deleterious scrubbing or abrasive action thereon of dimples 97, 97a** in the contact plates so as to prevent the establishment of "hot spots" on the PTCR and maintain the desirable electrical characteristics or integrity thereof.

In the operation of electrical device 61 when assembled in circuit relation onto plug 124 and within the component parts of the electrical device disposed as shown in the drawings and as described above, an operator may energize motor 113 across line terminals L1, L2 by closing switch 129, FIG. 9. In this manner, power is supplied from line terminal L1, through the closed switch 129, lead 125 and male terminal 119 to both main winding 115 and start winding 117 of motor 113. From start winding 117, current flows through male terminal 121, female terminal 11 of electrical device 61, contact plate 69, PTCR 101, contact plate 69a, female terminal 11a, and therefrom through lead 109, terminal means 103 and lead 127 to line terminal L2. At the same time, current also passes in parallel circuit relation from main winding 115 through male terminal 123 to female terminal 11a of electrical device and therefrom through lead 109, terminal means 103 and lead 127 to line terminal L2.

As previously mentioned and as illustrated in FIG. 8, PTCR 101 is operable generally in response to current flow therethrough to increase its resistance generally as a function of its temperature; therefore, assuming the temperature of PTCR 101 to be rather low at the starting or start-up period of motor 113 when switch 129 is closed, the PTCR will initially pass current at a value sufficiently great enough to effect a desired starting torque of the motor during the start-up period thereof. As the temperature of PTCR 101 increases in response to the current flow therethrough, its resistance to such current flow also increases to a value which, in general, renders start winding 117 ineffective in the motor winding circuit so as to electrically disassociate the start winding from main winding 115. The point in time during the motor start-up period at which start winding 117 is rendered ineffective, as previously mentioned, may be predetermined so as to generally coincide with the desired running speed of motor 113. That is to say, start winding 117 may be generally disabled or rendered ineffective in the winding circuit of motor 113 generally about the same time the motor attains its running speed. Of course, PTCR 101 will not act to obviate current flow through start winding 117 during the running speed period of motor 113, but the PTCR will throttle or restrict the passage of such current flow to such a minimal or small value that the start winding is ineffective in the winding circuit of the motor. Of course, when the operator opens switch 129, circuit 111 is interrupted across line terminals L1, L2 and motor 113 is deenergized.

Referring again to FIGS. 1–9 in general and recapitulating at least in part with respect to the fore-going, a method in one form of the invention is provided for making electrical device 61 so as to generally isolate contact plate 69 thereof from at least limited displacement movement of female terminal 11 supported in the device and associated both mechanically and electrically with the contact plate upon the mounting of the female terminal to a mating terminal, such as one of male terminals 119, 121, 123. The method comprises integrally forming one of legs 35, 37 of the generally U-shaped tab or supporting section 17 with the socket portion or electrical connector section 15 of female terminal 11 for receiving the mating terminal and connecting the other of legs 35, 37 in both the mechanical and electrical association with contact plate 69 so that at least one of the one and other legs 35, 37 generally absorbs the limited displacement movement of female terminal 11 upon the mounting or assembly thereof to the mating terminal.

Figure 10:
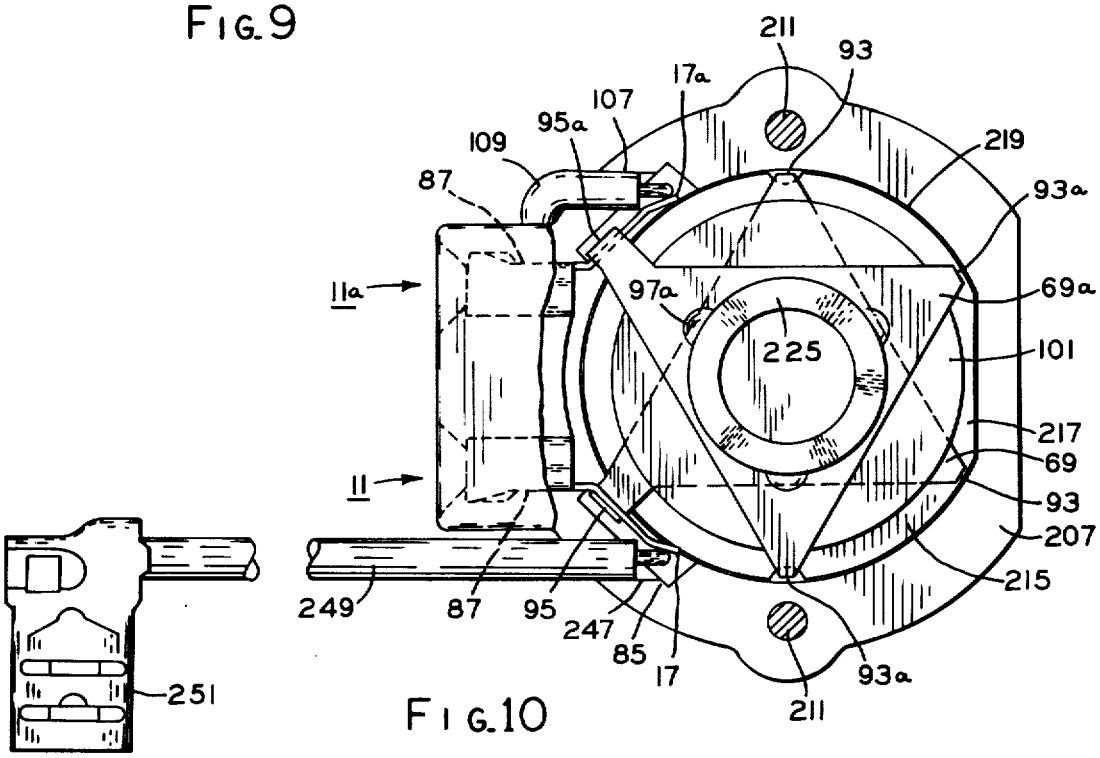
Figure 11:
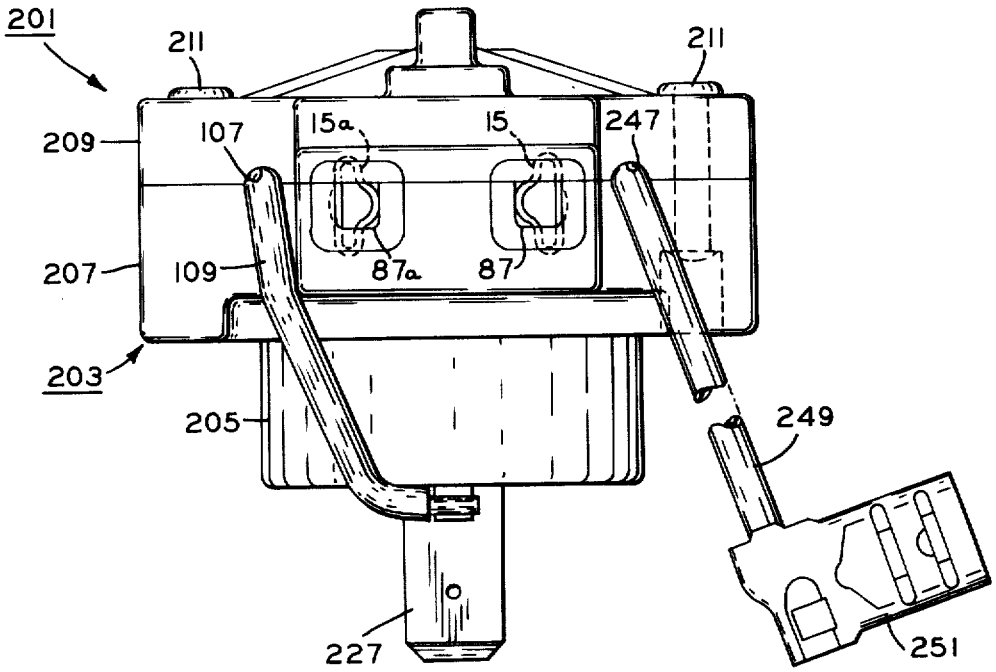
Figure 12:
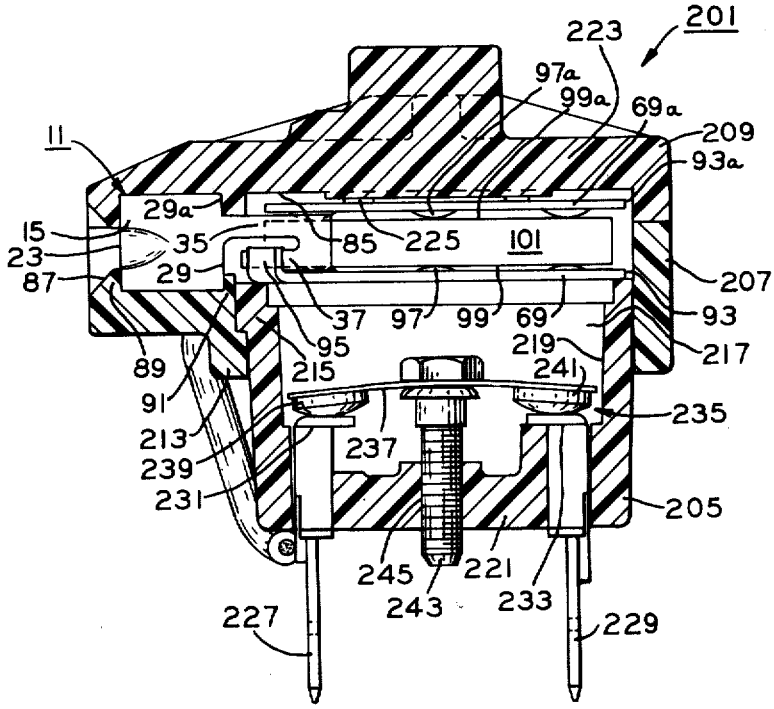

Another electrical device, such as a combination starter-protector device 201, in one form of the invention is shown in FIGS. 10–12 having generally the same component parts and functioning generally in the same manner as the above described electrical device 61 with the exceptions discussed hereinafter, and it is believed that electrical device 201 may have additional objects and advantageous features of its own as well as meeting at least some of the objects and advantageous features set out above with respect to electrical device 61.

Electrical device 201 is provided with a casing 203 comprising a plurality of casing members, such as a lower casing member or receptacle 205, an intermediate casing member 207 and an upper casing member or cover 209, which are interconnected against displacement from each other by suitable means, such as a plurality of rivets 211. Intermediate casing member 207 and receptacle 209 are respectively provided with generally annular overlapping or interfitting flages 213, 215 which are abutted together. Casing 203 has a plurality of wall means defining a chamber 217 therewithin, and the wall means plurality includes a sidewall or sidewall means 219 respectively formed on casing members 205, 207, 209 and interconnected with a pair of generally opposite end walls 221, 223 respectively formed on casing members 205, 209.

Intermediate casing member 207 and cover 209 include recess means 85 which is provided in sidewall 219 so as to communicate with chamber 217, and openings 87, 87a are also provided through the sidewall of the intermediate casing member and cover so as to intersect with the recess means. Electrical connection sections 15, 15a are received in openings 87, 87a so as to be at least limitedly displacably movable therein when mounted to male terminals 121, 123, as previously discussed hereinabove with respect to electrical device 61. Stops 89, 91 and 89a and 91a are also provided on intermediate casing member 207 and cover 209 for abutment with end edge 23 and shoulders 29, 29a on electrical connector sections 15, 15a of terminals 11, 11a so as to contain the electrical connector sections in openings 87, 87a, respectively. Supporting sections 17, 17a of terminals 11, 11a extend from electrical connector sections 15, 15a thereof so as to be respectively disposed or positioned in recess means 85.

PTCR 101 is disposed in the electrical contacting and positioning engagement between dimples 97, 97a of contact plates 69, 69a within chamber 217, and abutment means 93, 93a of the contact plates are disposed for positioning or locating engagement with sidewall 219 of intermediate casing member 207 and cover 209. Contact plate 69 is abutted or supported on the interior free end of flange 215 on receptacle 205, and resilient means, such as a generally thin wavy washer 225 or the like, is biased between end wall 223 of cover 209 and contact plate 69a. In this manner, contact plate 69a is urged toward the electrical contacting and positioning engagement with opposite side 99a of PTCR 101 and the other opposite side 99 of the PTCR is urged into the electrical contacting and positioning engagement with contact plate 69 so as to maintain contact plate 69 in its seated or supported engagement with the free end of flange 215 on receptacle 205. Fingers 95, 95a of contact plate 69, 69a are respectively connected in both the mechanical and electrical conductive engagement with the free ends 21, 21a of of legs 35, 35a on supporting sections 17, 17a of terminals 11, 11a.

Another pair of terminals 227, 229 extend through end wall 221 of receptacle 205 being integrally cast therein or otherwise retained therein by suitable means, and the interior end portions of the terminals respectively define a pair of contacts 231, 233 within chamber 217 generally adjacent end wall 221 while the exterior end portion of the terminals are adapted for receiving quick connect or disconnect fittings (not shown) in circuit relation. Interrupting means, such as a current carrying thermal-responsive switch means, indicated generally at 235, is provided with a flexible, generally disc-shaped switch actuator or element 237 formed of a current carrying material, such as for instance a bimetal, and another pair of movable contacts 239, 241 are mounted to the switch actuator being disposed in making engagement with contacts 231, 233 of terminals 227, 229 when the switch actuator is in its at-rest position. Switch actuator 237 is generally centrally mounted to or carried on an adjusting screw 243 which is adjustably or threadedly received in a threaded opening 245 in end wall 221 of receptacle 205 to adjust the bias on the switch actuator urging its movable contacts 239, 241 into the making engagement with contacts 231, 233 of terminals 227, 229, respectively. While switch means 235 is presented herein for purposes of disclosure, it is contemplated that other types of switch means having various configurations may be utilized in the present invention so as to meet the objects and advantageous features thereof. It may be noted that switch actuator 237 is spaced generally adjacent contact plate 69 within chamber 217 so as to be disposed in heat transfer relation with PTCR 101, as discussed in detail hereinafter, and if desired, at least one opening (not shown) may be provided through contact plate 69 for facilitating the transfer of heat from the PTCR to the switch actuator.

Lead receiving opening 107 is provided in intermediate casing member 207 and cover 209 through sidewall 219 thereof so as to intersect with recess means 85, and electrical lead 109 extends through opening 107 having an interior end electrically connected to supporting section 17a of terminal 11a and an exterior end electrically connected with terminal 227. Another lead receiving opening 247 is also provided in intermediate casing member 207 and cover 209 through sidewall 219 thereof so as to intersect with recess means 85, and another electrical lead 249 extends through opening 247 having an interior end electrically connected to supporting section 17 of terminal 11 and having a quick connect or disconnect electrical fitting 251 on the exterior end thereof.

Figure 13:
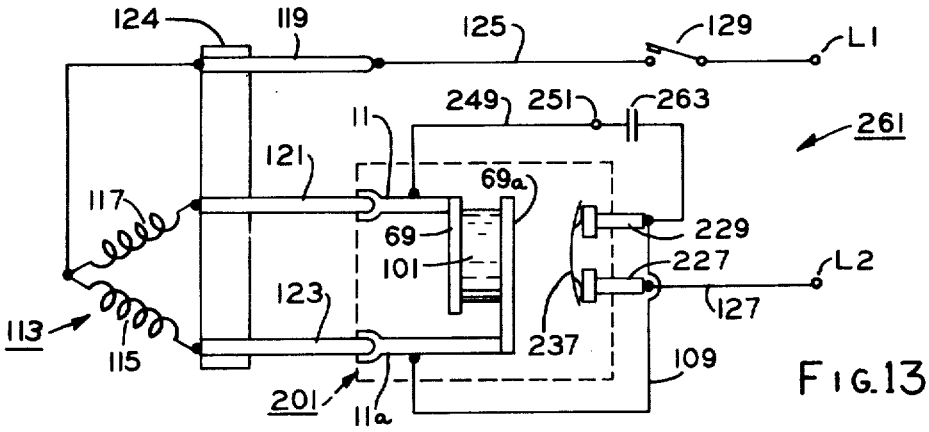

In FIG. 13, another circuit or system 261 is shown having generally the same components and functioning generally in the same manner as the previously discribed circuit 111 with the following exceptions. In circuit 261, female terminals of electrical device 201 are disposed to releasably or grippingly receive male terminals 121, 123 in plug 124 when the electrical device is associated or assembled with motor 113. Lead 125 having starter switch 129 interposed therein is connected between male terminal 119 and line terminal L1, and lead 127 is connected between terminal 227 of electrical device 201 and line terminal L2. A capacitor 263 is connected in circuit relation between terminal 229 of electrical device 201 and electrical fitting 251 of lead 249 extending from the electrical device.

As previously mentioned, variations in the tolerances of male terminals 119, 121, 123 with respect to the size thereof and/or the spaced relation therebetween in plug member 124 are, of course, encountered, and such tolerance variations may also occur in electrical connection sections 15, 15a of terminals 11, 11a in electrical device 201. Due to the aforementioned tolerance variations, electrical connector sections 15, 15a of terminals 11, 11a may twist and/or be both laterally and longitudinally moved or moved or otherwise displaced within their respective openings 87, 87a of intermediate casing member 207 and cover 209 when the electrical connector sections are releasably or girppingly engaged in electrical conductive relation on male terminals 121, 123 so as to mount electrical device 201 in circuit relation on mounting plug 124. Upon the assembly of electrical device 201 to mounting plug 124, as above described, the transmission or translation of the displacement movement of electrical connector sections 15, 15a through supporting sections 17, 17a of terminals 11, 11a to contact plates 69, 69a is at least predeterminately limited or accommodated by the yielding or resiling of at least one of legs 35, 37 and legs 35a, 37a of the supporting sections, respectively. In this manner, the above described means of supporting sections 17, 17a for accommodating the displacement movement of electrical connector sections 15, 15a at least predeterminately limits or obviates the transmission of such displacement movement to contact plates 69, 69a so as to maintain them generally in their assembled positions within chamber 217 of casing 203 which results in the preservation of the chemically coated opposite sides 99, 99a of PTCR 101 from deleterious scrubbing or abrasive action thereof of dimples 97, 97a in the contact plates so as to prevent the establishment of "hot spots" on the PTCR and maintain the desirable electrical characteristics or integrity thereof.

In the operation of electrical device 201 when assembled in circuit relation onto plug 124 and with the component parts of the electrical device disposed as shown in FIGS. 10–13 and as described above, motor 113 is energized in circuit 261 across line terminals L1, L2 upon closure of switch 129. In this manner, power is supplied from line terminal L1 through lead 125, closed switch 129 therein, male terminal 119 to both main winding 115 and start winding 117 of motor 113. From main winding 115, the current flows through male terminal 123, female terminal 11*a* of electrical device 201 and lead 109 to terminal 229 thereof, and from terminal 229 through switch actuator 237, terminal 227 and lead 127 to line terminal L2. At the same time, current also passes in parallel circuit relation from start winding 117 through male terminal 121, female terminal 11 of electrical device, contact plate 69, PTCR 101, contact plate 69*a* to female terminal 11*a* and therefrom through lead 109 and terminal 227 of the electrical device to lead 127 and line terminal L2. It may also be noted that capacitor 263 is charged by current flowing through electrical device 201 from female terminal 11*a* thereof through lead 249 and the capacitor to terminal 229 of the electrical device and there-from through switch actuator 237 and terminal 227 to lead 127 and line terminal L2. Of course, capacitor 263 is operable to shift the phase of the current through start winding 117 of motor 113 to effect a desired starting torque of the motor during the starting or start-up period thereof. Further, as the temperature of PTCR 101 increases in response to current flow therethrough, its resistance to such current flow also increases to a value which, in general, renders start winding 117 ineffective in the motor winding circuit, as previously mentioned and as illustrated in the graphical representation of FIG. 8. The point in time during the motor start-up period at which start winding 117 is rendered ineffective may be predetermined so as to occur generally when motor 113 has attained its running speed.

As well-known in the art, winding circuit or motor overload may have deleterious affects on the components of a motor, such as for instance the shorting or burning-out of the motor windings or winding circuit. These overloads or overload conditions may be effected by a plurality of different causes or by combinations of such causes. For instance, some of the well-known causes of these overload conditions are: a running overload; a high temperature overload; an overload occasioned by a stalled or locked rotor; and a high current overload. Irrespective of the particular cause or combination of causes effecting such an overload condition, a deleteriously high current is drawn by the motor, and such high current is usually accompanied by or results in a high temperature condition. Therefore, for the sake of simplifying the discussion of motor overloads or overload conditions hereinafter, it is to be understood that any cause or causes for effecting such motor overload will be discussed only within the context of a high current draw or condition accompanied by a high temperature or thermal condition with respect to the motor winding circuit.

During the start-up and running periods of motor 113, switch means 235 is disposed in its circuit making or completing position in circuit 261 engaging movable contacts 239, 241 with stationary contacts 231, 233. In the circuit making position of switch means 235, bimetal switch blade 237 thereof is heated in response to current flow therethrough as well as the heat transmitted thereto from PTCR 101. When motor 113 is running or energized under normal operating conditions, the heat generated in bimetal switch blade 237 and the heat transferred thereto is predeterminately less than that necessary for effecting movement of the bimetal switch blade from its circuit making position toward a circuit breaking or interrupting position so as to disengage or break movable contacts 239, 241 from stationary contacts 231, 233.

In the event of the occurrence of an overload or high current condition, a relatively large amount of current may be drawn in the motor winding circuit which could deleteriously affect main winding 115 and start winding 117, as previously mentioned. However, bimetal switch blade 237 is responsive to such high current drawn therethrough to correspondingly increase its generated heat thereby to effect characteristic actuation of the bimetal switch blade to its interrupting position breaking movable contacts 239, 241 from stationary contacts 231, 233 to interrupt or open circuit 261. In this manner, the motor winding circuit is automatically taken off the line to de-energize motor 113 in the event of the occurrence of an overload condition or winding circuit overload which may exist across line terminals L1, L2.

Of course, opening of circuit 261, as discussed above, also effects the de-energization of PTCR 101 and the resulant cooling of the PTCR and switch means 235. Even with the supplemental heat supplied or transferred from PTCR 101 to switch means 235, the switch means may cool sufficiently in its circuit interrupting position so as to cycle several or a plurality of times between its circuit interrupting position and the circuit completing position thereof. Such cycling of switch means 235 may occur throughout or over a period of a relatively short time and is effective to replace the motor winding circuit in circuit relation across power terminals L1, L2 for relatively very short periods of time; however, the period of time the motor winding circuit is thus cycled into circuit relation across the power terminal will not deleteriously affect the motor winding circuit since such time period is very short, as previously mentioned. When switch means 235 is so cycled to its circuit completing position, PTCR 101 is re-energized to again transmit heat to the switch means, and bimetal switch blade 237 is also again responsive to the overload condition to again generate heat during the aforementioned relatively short period of time thereby to again effect the cyclical movement or actuation of the switch means to its circuit interrupting position. Even in view of this cycling of switch means 235 for brief periods of time subsequent to the occurrence of the overload condition, it has been found that the supplemental heat transferred from PTCR 101 to the switch means is effective to increase the "off-time" thereof, i.e., when the switch means is in its circuit interrupting position, throughout the aforementioned relatively short period of time. Therefore, the increased "off-time" of electrical device 201 occasioned by the supplemental heat transferred from PTCR 101 to switch means 235 allows the PTCR itself to cool. When the resistance and temperature of PTCR 101 are so reduced to a sufficiently low value, the PTCR will again permit the passge therethrough of current at sufficiently high enough values to again effect energization of start winding 117 in the motor winding circuit so as to restart motor 113. Therefore, when switch means 235 also cools enough to cycle back to its circuit completing position and remain there, current is drawn through PTCR 101 at values great enough to effect the re-energization of start winding 117 to aid re-energized main winding 115 in the motor winding circuit in bringing motor 113 up to its running speed. When motor 113 attains its running speed, the self-heating effect of PTCR 101 once again raises its temperature and resistance to reduce current flow therethrough to a value rendering start winding 117 ineffective in the motor winding circuit. Thus, restarting of motor 113 assumes that the cause of the overload condition has been alleviated or corrected, and if not so alleviated, electrical device 201 may again operate or function as above described to take motor 113 off the line across power terminals L1, L2.

From the foregoing, it is now apparent that novel electrical devices 61, 201 and a novel method of making such have been provided meeting the objects and advantages set out hereinbefore, as well as others, and that changes in the precise arrangements, shapes, connections and details of the construction set forth herein, as well as the precise order of the method steps, may be made by those having ordinary skill in the art without departing from the spirit of the invention or the scope thereof as set out by the claims which follow.

What we claim as new and desire to secure by Letters Patent of the United States is:

1. An electrical device adapted to be associated in electrical mounting engagement with a pair of stationary male mounting terminals for connection in circuit relation with a winding circuit of a dynamoelectric machine, the electrical device comprising a casing; a plurality of wall means on said casing defining a chamber therein and including a pair of opposed end walls, and a sidewall interposed between said end walls; a PTCR; a pair of contact plates disposed in electrical and supporting engagement across said PTCR and mounted in said chamber between said end walls; means on said contact plates for positioning engagement with said sidewall, respectively; first and second apertures in said casing and extending through said sidewall so as to communicate with said chamber; said chamber including recess means in said sidewall and intersecting with at least one of said first and second apertures; first and second female terminals of a generally thin metal having good electrical conductive characteristics and respectively including first and second electrical connector sections generally confined in said first and second apertures and adapted for the association in the electrical mounting engagement with the male mounting terminal pair, and first and second supporting sections integral with said first and second electrical connector sections for connection in electrical conductive engagement with said contact plates; a first end portion of said first supporting section disposed in said chamber and connected in the electrical conductive engagement with one of said contact plates; said second electrical connector section including a split sleeve portion in said second aperture and disposed for limited displacement movement therein, an opening in said split sleeve portion generally aligned with said second aperture and in which one of the male mounting terminals may be received upon the association in the electrical mounting engagement of the first and second electrical connector sections with the male mounting terminal pair; said second supporting section being disposed generally in said recess means and including a distal end portion spaced from said split sleeve portion, a first leg integrally formed between said split sleeve portion and said distal end portion, a second leg integrally formed with said distal end portion and extending generally in laterally spaced relation with said first leg, a second end portion on said second leg spaced generally adjacent said split sleeve portion and connected in the electrical conductive and mechanical engagement with the other of said contact plates, and at least one of said first leg and said second leg including a section operable generally to yield in the event of the occurrence of the displacement movement of the split sleeve portion in said second aperture upon the association of said first and second electrical connector sections in the electrical mounting engagement with the male mounting terminal pair so as to at least in part limit the translation of the displacement movement of said split sleeve portion through the second supporting section to said other contact plate.

2. An electrical device adapted to be associated in electrical contacting engagement with at least one terminal means, the electrical device comprising a casing; an electrical component in said casing; means for receiving the at least one terminal means in the electrical contacting engagement therewith and arranged in said casing so as to be limitedly displacably movable; means extending from said receiving means for connection in both electrical contacting engagement and mechanical engagement with said electrical component so as to at least in part support said electrical component in said casing, and said connection means including means for accommodating the limited displacement movement of said receiving means so as to at least generally isolate said electrical component from the limited displacement movement in the event of the occurrence thereof when said receiving means is associated in the electrical contacting engagement with the at least one terminal means.

3. An electrical device as set forth in claim 2 wherein said connection means comprises a generally U-shaped configuration integral with said receiving means and having a free end portion disposed in both the electrical contacting engagement and the mechanical engagement with said electrical component.

4. An electrical device as set forth in claim 2 wherein said connection means comprises a pair of spaced apart legs having integrally connected generally opposite adjacent ends, one of said legs being integral with said receiving means and the other of said legs having a free end portion disposed in both the electrical contacting engagement and the mechanical engagement with the electrical component, and at least one of said one and other legs including said accommodating means.

5. An electrical device as set forth in claim 2 further comprising a PTCR supported at least in part in said casing by said electrical component in electrical contacting engagement therewith.

6. An electrical device as set forth in claim 5 further comprising thermally responsive current carrying switch means disposed in said casing for heat transfer relation with said PTCR.

7. An electrical device adapted to be associated in electrical contacting engagement with a set of terminals, the electrical device comprising a casing; a PTCR; a pair of means for electrically contacting and supporting said PTCR within said casing; and a set of means disposed in said casing so as to be limitedly displacably movable for receiving respective ones of the terminals of the terminal set in the electrical contacting engagement therewith and connected in electrical conductive engagement with said contact and supporting means, and at least one of said receiving means of said set thereof including means for at least limiting translation of the displacement movement from said at least one receiving means to one of said contacting and supporting means in the event of the occurrence of the displacement movement of said at least one receiving means when it is associated with its respective one terminal.

8. An electrical device as set forth in claim 7 further comprising switch means disposed in said casing generally adjacent said PTCR for heat transfer relation therewith.

9. An electrical device as set forth in claim 7 wherein said receiving means respectively comprise socket means accessible from exteriorly of said casing and with which the respective one terminal may be associated in the electrical contacting engagement therewith.

10. An electrical device as set forth in claim 7 wherein said translation limiting means comprises at least one yieldable section and associated with the at least one receiving means.

11. An electrical device as set forth in claim 7 wherein said at least one receiving means further includes a pair of legs, one of said legs being integral with said at least one receiving means, an end portion on the other of said legs spaced generally adjacent said at least receiving means and connected in the electrical conductive engagement with said one contact and supporting means, and said translation limiting means comprising a section in at least one of said one leg and said other leg operable generally to yield in the event of the occurrence of the displacement movement of said at least one receiving means when it is associated with its respective one terminal.

12. An electrical device adapted to be mounted in assembly relation with a set of male mounting terminals, the electrical device comprising a casing; a PTCR; a pair of means for electrical contact across said PTCR and for positioning said PTCR within said casing; a pair of female terminal means connected in electrical conductive relation with said contact and positioning means and arranged in said casing for the mounting in the assembly relation with respective ones of the male mounting terminals of the set thereof, at least a part of at least one of said female terminal means being adapted for limited displacement movement in said casing upon the mounting assembly relation of said female terminal means with its respective one male mounting terminal, and means integral with said at least part of said at least one female terminal means and mechanically connected with one of said contact and positioning means for generally isolating said one contact and positioning means from the displacement movement of said at least part of said at least one female terminal means in the event of the occurrence of the displacement movement upon the mounting assembly relation of said female terminal means with the respective ones of the male mounting terminal.

13. An electrical device as set forth in claim 12 further comprising circuit means arranged at least in part within said casing and connected with one of said contact and positioning means.

14. An electrical device as set forth in claim 13 further comprising switch means connected in said circuit means and disposed generally adjacent said PTCR for heat transfer relation therewith.

15. An electrical device as set forth in claim 14 further comprising means disposed in said casing and extending exteriorly thereof adapted for coupling said circuit means to a power source.

16. An electrical device adapted to be associated with a set of male mounting terminals for connection in circuit relation with a winding circuit of a dynamoelectric machine, the electrical device comprising a casing; means for controlling starting of the dynamoelectric machine; a pair of means disposed in said casing for electrical contacting and supporting engagement across said starting controlling means; and a pair of female terminal means for the association with two male mounting terminals of the set thereof and respectively including means for receiving in electrical contacting engagement a respective one of the two terminals and disposed so as to be limitedly displacably movable in said casing upon the association of said female terminals with the two male mounting terminals, means integral with said receiving means for connection in electrical conductive engagement with respective ones of said contacting and supporting means, and said connection means including means operable generally for yielding in the event of the occurrence of the displacement movement upon the association of said female terminal means with the two male mounting terminals so as to at least limit the translation of the displacement movement to said respective ones of said contacting and supporting means.

17. An electrical device as set forth in claim 16 wherein said connection means each comprise a bight portion spaced from said receiving means, a pair of spaced apart legs integral with said bight portion, one of said legs also being integral with said receiving means, and a end portion on the other of said legs connected in the electrical conductive engagement with said respective one contacting and supporting means.

18. An electrical device as set forth in claim 17 wherein said yielding means respectively comprise a section in at least one of said one leg and said other leg adapted to resile in the event of the occurrence of the displacement movement of the receiving means.

19. An electrical device as set forth in claim 16 wherein said receiving means respectively comprise a split sleeve portion having an opening therein into which the respective one of the two terminals may be inserted in the electrical contacting engagement upon the association of said female terminal means with the two male mounting terminals.

20. An electrical device as set forth in claim 16 wherein said female terminal means are formed from a generally thin metal having good electrical conductive characteristics, said connection means comprising a generally U-shaped configuration integral with said receiving means and having a free end disposed generally adjacent said receiving means so as to be connected in the electrical conductive engagement with said contact and supporting means, respectively.

21. An electrical device comprising a casing; a plurality of wall means on said casing; a chamber in said casing within said wall means plurality thereof; an opening extending through one of said wall means of said wall means plurality so as to communicate with said chamber; a split sleeve contained within said opening and adapted for limited displacement movement therein upon the assembly of said split sleeve onto a male mounting terminal; a first extension integral with said split sleeve and extending therefrom generally into said chamber so as to be disposed at least adjacent said one wall means, a bight portion integral with said first extension, a second extension integral with said bight portion and disposed in spaced relation with said first extension, an end portion on said second extension, and an electrical component in said chamber and including means for electrical conductive engagement with said end portion, and at least one of said first extension and said second extension including a yieldable section operable generally to accommodate the limited displacement movement of said split sleeve in response to the assembly thereof onto the male mounting terminal so as to generally isolate said electrical component from the limited displacement movement of said split sleeve portion.

22. An electrical device adapted to be associated in electrical mounting relation with a set of male mounting terminals for connection in circuit relation with a start winding and a run winding of a winding circuit for a dynamoelectric machine, the electrical device comprising a casing; a plurality of wall means on said casing; a chamber in said casing within said wall means plurality; a pair of apertures extending through one of said wall means of said wall means plurality so as to communicate with said chamber; said chamber including at least one recess means in said one wall means intersecting with at least one of said apertures; means in said chamber adapter for controlling energization of the start winding and operable generally in response to current applied thereto to increase its resistance generally as a function of its temperature; a pair of opposed contact plates disposed in electrical contacting engagement across said controlling means so as to support said controlling means within said chamber in predetermined spaced relation with said wall means of said wall means plurality; means on said contact plates for positioning engagement with at least said one wall means, respectively; a first female terminal means adapted for the association in the electrical mounting relation with one of the male mounting terminals of the set thereof and including means disposed within one of said apertures for receiving the one male mounting terminal in the electrical mounting relation and also connected in electrical conductive relation with one of said contact plates; a second female terminal means adapted for the association in the electrical mounting engagement with another of the male mounting terminals of the set thereof and including a split sleeve portion for receiving the another male mounting terminal in the electrical mounting relation and disposed in the other of said apertures for limited displacement movement upon the association of said first and second female terminal means with the one and other male mounting terminals, respectively, a first leg integral with said split sleeve portion and extending therefrom into said at least one recess means, a distal end portion integral with said first leg and spaced from said split sleeve portion so as to be disposed at least in part in said at least one recess means, a second leg integral with said distal end portion, and an end portion on said second leg spaced generally adjacent said split sleeve portion and connected in electrical conductive relation with the other of said contact plates; another circuit adapter for controlling the passage of current to the winding circuit including thermal responsive current carrying switch means mounted in said chamber to another of said wall means of said wall means plurality and operable from a current passing position in said another circuit toward a current interrupting position, means for connecting said switch means in circuit relation with one of said one and other contact plates, and said controlling means and switch means being associated in heat transfer relation within said chamber so as to delay the return of said switch means from its current interrupting position to its current passing position in response to heat generated by said controlling means upon the application of current thereto.

23. A method of making an electrical device so as to generally isolate an electrical component thereof from limited displacement movement of terminal means supported in the device and associated both mechanically and electrically with the electrical component upon the mounting of the terminal means to a mating terminal, the method comprising integrally forming one of a pair of legs of a generally U-shaped tab with a socket portion of the terminal means for receiving the mating terminal and connecting the other of the legs in both the mechanical and electrical association with the electrical component so that at least one of the one and other legs generally absorbs the limited displacement movement of the terminal means upon the mounting thereof to the mating terminal.

24. A method of making an electrical device having a casing, a PTCR, a pair of contact plates for electrically contacting and supporting the PTCR in the casing, and a pair of terminal means including an electrical connection section for limited displacement movement in the casing upon the assembly thereof with mating terminals, and a supporting section for mechanical and electrical connection with the contact plates and having means for generally isolating the contact plates from the transmission thereto of the displacement movement of the electrical connector sections, respectively, the method comprising the steps of:

(a) forming the electrical connector section integrally with the supporting section of the terminal means and predeterminately providing the isolating means in the supporting section;

(b) engaging both mechanically and electrically the supporting sections of the terminal means with the contact plates, respectively;

(c) assembling the PTCR between the contact plates in the electrical contacting and supporting engagement therewith and positioning the PTCR, contact plates and terminal means within the casing with the electrical connector sections disposed for the limited displacement movement thereof upon the gripping engagement with the mating terminals and with the isolating means operable generally to at least limit the transmission of the limited displacement movement of the electrical connector section through the supporting section to the contact plate, respectively.

25. An electrical device adapted to be associated in electrical contacting engagement with at least one terminal means, the electrical device comprising a casing; an electrical component in said casing; means adapted for receiving the at least one terminal means in the electrical contacting engagement therewith and disposed in said casing so as to be limitedly displacably movable; means extending from said receiving means for connection in both electrical contacting engagement and mechanical engagement with said electrical component so as to support said electrical component in said casing, said connection means including a pair of spaced apart legs having integrally connected generally opposite adjacent ends, one of said legs being integral with said receiving means and the other of said legs having a free end portion disposed in both the electrical contacting engagement and the mechanical engagement with the electrical component, and at least one of said one and other legs including means for accommodating the limited displacement movement of said receiving means so as to at least generally isolate said electrical component from the limited displacement in the event of the occurrence thereof upon the association of said receiving means with the at least one terminal means.

26. An electrical device adapted to be associated in electrical contacting engagement with a set of terminals for connection in circuit relation with a winding circuit of a dynamoelectric machine, the electrical device comprising a casing; means adapted for controlling starting of the dynamo-electric machine; a pair of means for electrically contacting and supporting said starting controlling means within said casing; and a set of means disposed in said casing so as to be limitedly displaceably movably adapted for receiving respective ones of the terminals of the terminal set upon the association in the electrical contacting engagement therewith and connected in electrical conductive engagement with said contact and supporting means, and at least one of said receiving means of said set thereof including a pair of legs arranged generally in a U-shaped configuration, one of said legs being integral with said at least one receiving means, an end portion on the other of said legs spaced generally adjacent said at least one receiving means and connected in the electrical conductive engagement with one of said contact and supporting means, and means in at least one of said one leg and said other leg operable generally to yield for at least limiting translation of the displacement movement from said receiving means to said one contacting and supporting means in the event of the occurrence of the displacement movement upon the association of said receiving means with the respective ones of the terminals.

27. An electrical device adapted to be associated with a set of male mounting terminals for connection in circuit relation with a winding circuit of a dynamoelectric machine, the electrical device comprising a casing; means adapted for controlling starting of the dynamoelectric machine; a pair of means disposed in said casing for electrical contacting and supporting engagement across said starting controlling means; and a pair of female terminal means adapted for the association with two male mounting terminals of the set thereof and respectively including means for receiving in electrical contacting engagement a respective one of the two terminals and disposed so as to be limitedly displacably movable in said casing upon the association of said female terminals with the two male mounting terminals, means integral with said receiving means for connection in electrical conductive engagement with said contacting and supporting means, and said connection means including a bight portion spaced from said receiving means, a pair of spaced apart legs integral with said bight portion, one of said legs also being integral with said receiving means, an end portion on the other of said legs connected in the electrical conductive engagement with said respective one contacting and supporting means, and means in at least one of said one leg and said other leg operable generally for yielding in the event of the occurrence of the displacement movement upon the association of said female terminal means with the two male mounting terminals so as to at least limit the translation of the displacement movement to said contacting and supporting means.

* * * * *